US008522896B2

(12) United States Patent
Rowden

(10) Patent No.: US 8,522,896 B2
(45) Date of Patent: Sep. 3, 2013

(54) CONSISTENT DRILLING FLUIDS ENGINEERING AND MANAGEMENT

(76) Inventor: Michael V. Rowden, Tyler, TX (US)

( * ) Notice: Subject to any disclaimer, the term of this patent is extended or adjusted under 35 U.S.C. 154(b) by 358 days.

(21) Appl. No.: 12/963,771

(22) Filed: Dec. 9, 2010

(65) Prior Publication Data

US 2012/0145456 A1 Jun. 14, 2012

(51) Int. Cl.
*C09K 8/02* (2006.01)
*E21B 47/00* (2012.01)

(52) U.S. Cl.
USPC ..... 175/38; 175/40; 166/250.01; 166/75.15; 73/152.04

(58) Field of Classification Search
USPC ..... 175/38, 40; 166/250.01, 305.1, 166/75.12, 75.15; 73/152.01, 152.02, 152.03, 73/152.04
See application file for complete search history.

(56) References Cited

U.S. PATENT DOCUMENTS 3,899,926 A * 8/1975 Haden ..... 73/152.04

* cited by examiner

*Primary Examiner* — Giovanna Wright

*Assistant Examiner* — Catherine Loikith

(74) *Attorney, Agent, or Firm* — Eric C. Schmalbach

(57) ABSTRACT

Processes and apparatus that continuously change the physical state and characteristics of drilling fluids at planned periodic intervals to consistently and correctly compensate for differing geological formation properties, wellbore characteristics, rate of penetration, solids removal efficiency, and other essential factors involved in the drilling process, comprising: initiating a system correction of a Minimum Base Required ("MBR"); and administering a dilutant to a drilling fluid according to the MBR. The system corrections may be performed recursively, adjusting the system's base dilutant and chemical product additions according to MBR. The drilling fluid consistency produced is based upon several drilling-rig specific parameters. Drilling fluid consistency is provided onsite through the use of mathematical software, base fluid, rig software that targets the programmed parameters, and scheduled treatments that are structured for stability according to the minimum amount of base dilutant and required quantity of chemical product to produce consistent drilling fluid properties.

40 Claims, 11 Drawing Sheets

CONVERSION OF DRILLED SOLIDS

CONVERSION OF DRILLED SOLIDS

CONSISTENT DRILLING FLUIDS ENGINEERING AND MANAGEMENT

BACKGROUND

This invention relates to drilling fluids engineering and processes for providing consistent and stable fluid properties for wellbores drilled into the earth. Consistent drilling fluid properties must be maintained for efficient operation and to reduce the possibility of damage to geological formations, drilling equipment, and drilling equipment operators. Drilling fluids have numerous functions, including: maintaining hydrostatic pressure in the wellbore; removing cuttings in the wellbore; maintaining lubricated, clean, and cool drilling equipment; sealing permeable formations; controlling corrosion; providing impact force to the formation via the bit; and aiding in formation evaluation.

Differing formation properties, wellbore characteristics, rate of penetration, and other factors require precise corresponding drilling fluid properties. A problem encountered in drilling fluid operations is overcompensation of treatment by drilling fluid engineers. After the physical and chemical characteristics of drilling fluids are measured, steps are taken by the drilling fluids engineer to alter drilling fluid properties. These steps involve adding dilutant and chemical products to the drilling fluid. Generally, the very actions taken by the drilling fluids engineer systematically cause the drilling fluid properties to be outside of the dependent tolerable allowances due to the introduction of excess or insufficient dilutants and/or chemical products. Therefore, a need arises for a process that continuously changes the physical state and characteristics of drilling fluids to compensate for differing formation properties, wellbore characteristics, rate of penetration, solids removal efficiency, and other essential factors involved in the drilling process.

SUMMARY

The current invention solves the need for a process that continuously changes the physical state and characteristics of drilling fluids at planned periodic intervals to consistently and correctly compensate for differing formation properties, wellbore characteristics, rate of penetration, solids removal efficiency, and other essential factors involved in the drilling process. The process comprises: initiating a system correction of a Minimum Base Required ("MBR"); and administering a dilutant to a drilling fluid according to said MBR. The system corrections may be performed recursively, adjusting the dilutant administered to the MBR of the system. The drilling fluid consistency produced is based upon several rig specific parameters. Drilling fluid consistency is provided onsite through the use of mathematical software, timely base fluid delivery, rig software that targets the programmed parameters, and scheduled treatments that are structured for stability according to the minimum amount of base dilutant and calculated quantity of chemical product required.

DESCRIPTION OF THE DRAWINGS

These and other features, aspects and advantages of the present invention will become better understood with regard to the following description, appended claims, and accompanying drawings where:

DESCRIPTION

Definitions

Figure 1:
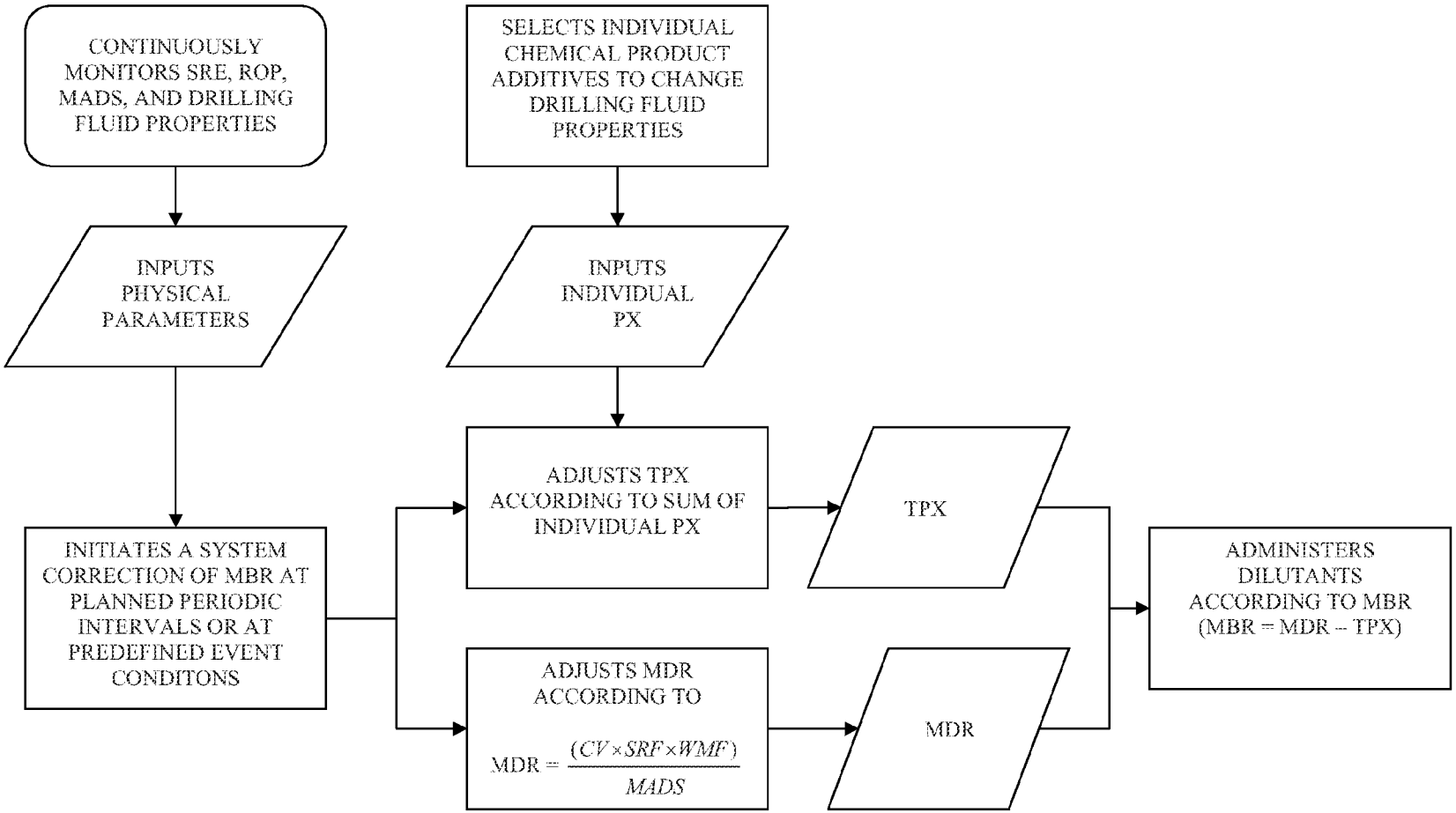
FIG. 1 is a flow sheet for a system of continuously changing the physical state and characteristics of a drilling fluid according to Minimum Base Dilutant Required ("MBR")

The current invention relies on relationships which continuously change the physical and chemical state of drilling fluids. Implementation of the relationships, according to the physical parameters supplied, will determine the correct treatment schedule. Definitions of the relationships are set forth herein.

Examples of the types of drilling fluids utilized include: compressed air; compressed air and water combinations; water; water based mud ("WBM"); oil-based mud ("OBM"); and synthetic based fluid ("SBM"). The specific type of drilling fluid selected depends on the conditions and selected purpose of the drilling operation. The selected properties of a selected fluid include viscosity control, shale stability/inhibition, lubricity, rate of penetration, environmental considerations, rheology control, and economic feasibility. WBM, SBM, or OBM are selected for 'best fit' characteristics as applied to a well.

A drill string encompasses a column or shaft inside the wellbore. The drill string comprises drilling pipe, heavyweight pipe, drilling collars, the drill bit, and drilling equipment within the collar assembly. Drilling fluids are pumped down the drill string by using equipment such as Triplex or Duplex mud pumps. Measurement While Drilling ("MWD") tools assist in performing measurements downhole and transmit information to the surface. As the drilling fluid circulates down the wellbore through the hollow drill string, drilled cuttings and other solids are introduced into the drilling fluid. The drilling fluids then circulate to the top of the wellbore via the annulus, where they are separated from drilled cuttings via Solids Control Equipment ("SCE").

The repetitive measuring and treatment steps of the current invention is carried out over a given time interval. The term "tour," as it is used in the current invention, refers to the length of time between the repetitive treatment steps of the current invention. For example, in a 12-hour tour, the process of the current invention may be selected or programmed to perform at least twice in a 24-hour period.

Cuttings Volume ("CV"), as it is used in this invention, refers to the volume of drilled solids in the calculated unit interval, with respect to a specified bit diameter, ROP, Solids Removal Efficiency ("SRE"), and tour length. For example, if a wellbore is drilled from 2500 ft to 3500 ft at a given ROP within a 12-hour tour, then CV would refer to the volume of the dirt and other sediment drilled and brought to the surface over this 1000 ft interval, during the 12 hours of drilling.

After the drilling fluid is circulated through the wellbore, SCE separates drilled solids from the drilling fluid. Base dilutants and chemical products are added to the drilling fluid to compensate for changes to drilling fluid properties since the last measurement. Drilling fluid properties changed by chemical products may include: density; lubricity; rheology; viscosity; density; pH levels; alkalinites; gel strengths; solids content; and filtrate control. The drilling fluids are then recirculated into the wellbore after treatment.

Two types of solids are present in a drilling fluid: drilled solids, such as dirt, silt, and sand retained by the base fluid during circulation through the wellbore; and functional/desirable solids. Functional/desirable solids include: high-specific-gravity solids ("HGS"), such as weighting agents; low-specific-gravity solids ("LGS"); and various liquid compounds that are added to change fluid properties. Drilled solids (also referred to as "cuttings") are undesirable, as they increase both the density and viscosity of the drilling fluid. This increase may cause damage to drilling equipment, formations, and put the operator at risk for drilling fluid problems. Solids are generally measured in units of percent by volume and/or pounds per barrel (1 barrel=42 US gallons).

As the drilling fluid circulates to the top of the wellbore and exits, it passes through various types of SCE. SCE are specifically designed to remove the drilled solids from the drilling fluid. Solids control equipment may include one or more of the following: fluids processing system; shale shaker; mud cleaner; desander; desilter; centrifuge; degasser; mud gas separator; and settling tank. Each device in practice may have an intended use and differing levels of efficiency.

The term Drilled Solids Fraction ("DSF"), as it is used in this invention, refers to the percentage of drilled solids in a remaining drilling fluid. DSF can be determined through field tests initiated by drilling fluids engineers. For example, the drilling fluids engineer can perform a retort test to determine percent by volume of solids content in the drilling fluid. Next, the drilling fluids engineer performs a Methylene Blue Test ("MBT") to determine the percent by volume of reactive solids. Using the results of the two tests, the drilling fluids engineer is able to determine the ratio of drilled solids to reactive solids, to determine DSF.

The term Solids Removal Efficiency ("SRE"), as it used in this invention, refers to the ability of the SCE in use to remove undesirable drilled solids. The aim of SCE is the removal of all unwanted drilled solids from drilling fluids. SCE may be highly efficient in achieving this, but in practice, not all of drilled solids are removed. "Actual Dilution Volume" refers to the actual volume of dilutant that was last added to the drilling fluid. SRE refers to the percentage of undesirable drilled solids the solids removal equipment are capable of removing. SRE is measured as a percentage and can be calculated according to the following:

$$SRE = 100\% - \frac{(ActualDilutionVolume \times DSF)}{CV}.$$

Figure 9:
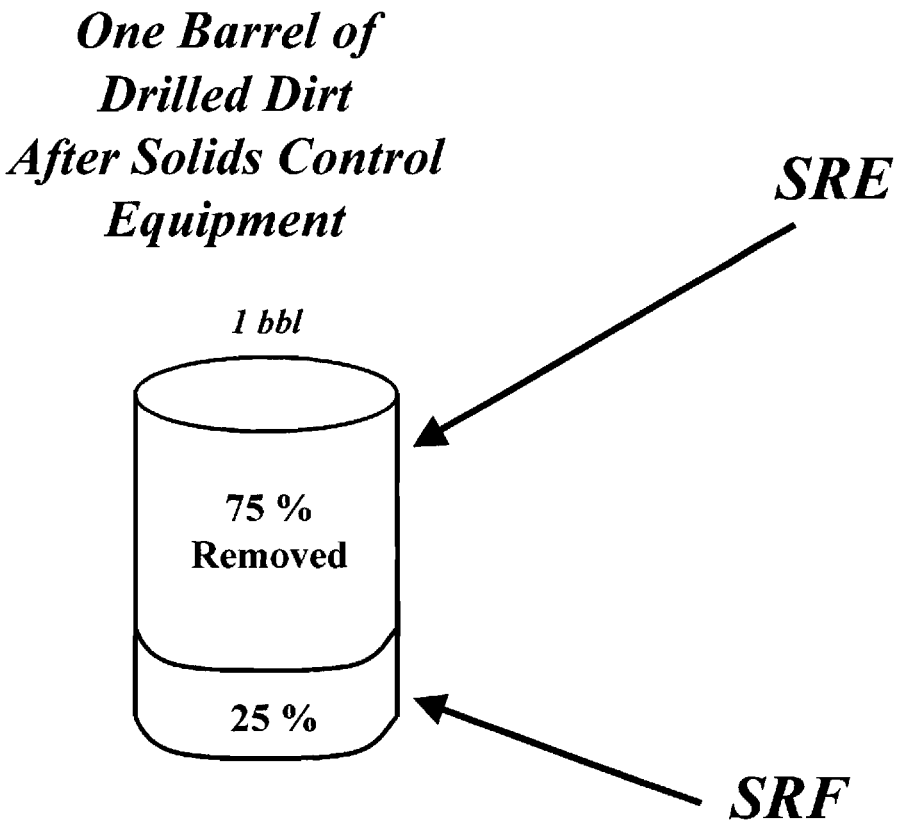
FIG. 9 is a diagram of the composition of one barrel of drilled dirt after Solids Control Equipment ("SCE"), illustrating Solids Removal Efficiency ("SRE") and Solids Retention Fraction ("SRF")

The percentage of drilled solids remaining is referred to as the Solids Retention Fraction ("SRF"). SRF is measured as a percentage, and may be calculated by as follows: SRF=100%−SRE. Conversely, SRF+SRE=100%. An example of SRE and SRF in one barrel of drilled dirt after treatment by SCE, is shown in FIG. 9.

Maximum Allowable Drilled Solids ("MADS"), as it is used in this invention, refers to a selected maximum ratio of the volume of undesirable drilled solids compared to the volume of drilling fluid. MADS is measured as a percentage. High MADS ratios will allow for more drilled solids in a fluid during drilling operations. Low MADS ratios will allow for less drilled solids, but will involve more dilutant. Therefore, a balance must be reached for optimization and efficiency. A particular MADS ratio may be selected by the drilling fluids engineer.

Figure 10:
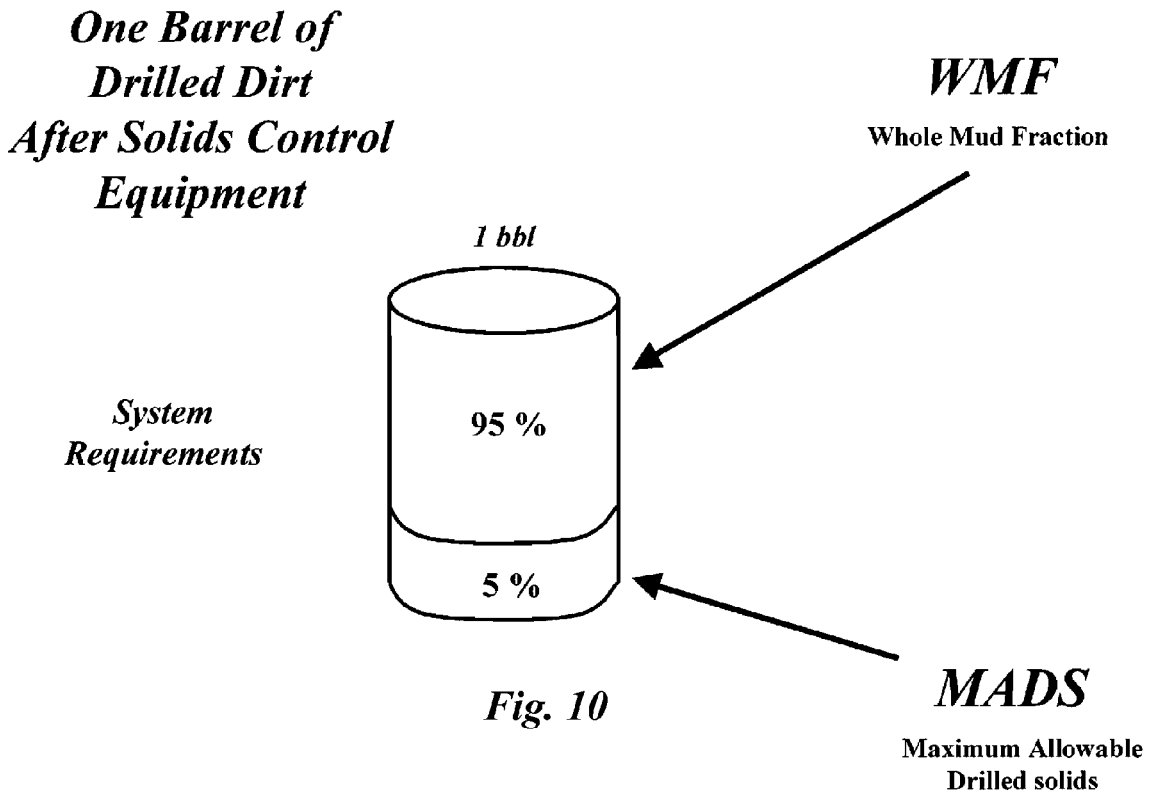
FIG. 10 is a diagram of the composition of one barrel of drilled dirt after Solids Control Equipment ("SCE"), illustrating Whole Mud Fraction ("WMF") and Maximum Allowable Drilled Solids ("MADS")

For a selected MADS ratio, the remaining percentage of fluids must not contain drilled solids. The remaining percentage, as it is used in this invention, is referred to as the Whole Mud Fraction ("WMF"). WMF is measured as a percentage and can be calculated as follows: WMF=100%−MADS. Conversely, WMF+MADS=100%. An example of WMF and MADS in one barrel of drilled dirt after treatment by SCE, is shown in FIG. 10.

Figure 11:
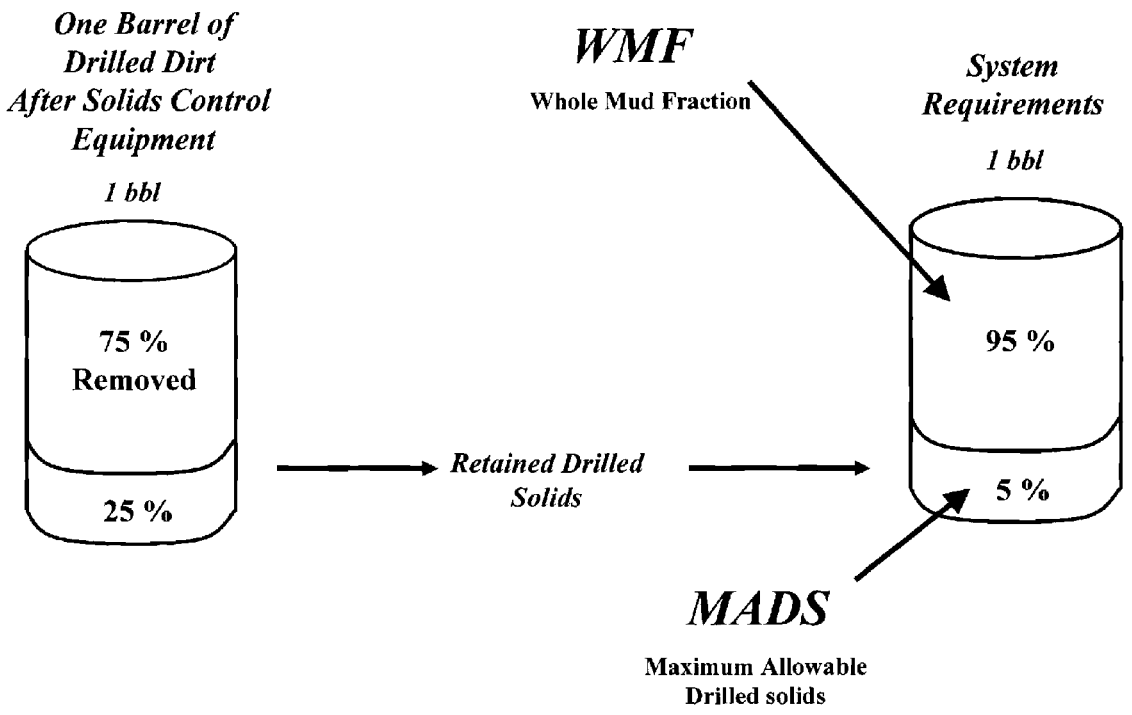
FIG. 11 is a diagram of the conversion of drilled solids with respect to one barrel of drilled dirt after Solids Control Equipment ("SCE"), illustrating WMF and MADS after conversion.

After passing through the solids control equipment in use, the drilling fluid must be converted to the designated MADS of the system. If the remaining percentage of drilled solids exceeds the MADS ratio, then the drilling fluids must be treated accordingly. Reducing the percentage of drilled solids is accomplished by calculated dilution. Dilution refers to the introduction of any solid or liquid into the drilling fluid which increases the volume of the drilling fluid. An example of the conversion in one barrel of drilled dirt after treatment by SCE is shown in FIG. 11.

Minimum Dilution Required ("MDR"), as it is used in this invention, refers to the volume of total dilutant that must be added so that the percentage of drilled solids remaining after treatment by the solids removal equipment equals that of the MADS ratio. MDR can be calculated as follows:

$$MDR = \frac{(CV \times SRF \times WMF)}{MADS}.$$

After the MDR is calculated, a programmed dilutant or combination of programmed dilutants are selected for introduction into the drilling fluid to increase the volume of the drilling fluid. As these dilutants (chemicals and base liquids) are added, the total volume will be increased due to chemical product expansions. Therefore, the chemical products need to be accounted for. Examples of chemical products tracked for expansion may include: weighting agents; viscosifiers; dispersants; lost circulation materials; salts; and drilled solids.

Drilled solids are incorporated into the drilling fluid as a result of the bit rotation/pressure and rig hydraulics. Cuttings are generated at the bottom of the well and drilling fluid brings these cuttings to the surface. SCE separates and removes the larger portion of the cuttings at the surface; however, a percentage of the cuttings remain in the fluid system. The cuttings that are removed are coated with the drilling fluid when removed from the system, thus, taking system fluid and product with them as they are removed from the system. Product Concentration Volume ("PCV") allows for the loss via Solids Control Equipment of these chemicals/fluids in order to maintain system product concentrations within the circulating fluid (and cuttings) that remain. PCV will be a larger number than MDR. PCV can be calculated as follows:

$$PCV = \frac{CV \times SRF \times (100 + MADS)}{MADS}.$$

As the chemical products are introduced into the fluid, a degree of expansion occurs according to the specific gravity of the particular chemical product(s). Expansion Volume ("EV") refers to the volume of expansion for each of the selected chemical products. EV (lbs of product per barrel) is calculated as the product of: the specific gravity of the particular chemical product; the weight of one gallon of water (8.33 lbs/g) which has a specific gravity of 1.00; and 42 (the number of gallons in one oilfield barrel). For every individual EV of chemical product introduced into the system, the system volume will be increased by one barrel. For example, EV can be calculated as follows:

$$EV\,(\text{lbs/bbl}) = \text{SpecificGravityofAdditive} \times \text{Weightof1GallonofWater} \times 42.$$

A given weight in pounds of each chemical additive ("Total Pounds of Additive") will usually be programmed and predetermined for each interval of a well. Accordingly, each given chemical additive will have its own Product Expansion ("PX"). An individual product's PX is measured as a volume (bbls) and can be calculated as follows:

$$PX = \frac{Totallbsofadditive \times PCV}{EV}.$$

As it is used in this invention, Total Product Expansion ("TPX") refers to the sum of all individual product expansion volumes (PX). TPX is measured as volume, and can be calculated as follows:

$$TPX = \Sigma(PX).$$

Minimum Base (fluid) Required ("MBR") is measured by volume (bbl), and refers to the minimum volume of base dilutant that must be added in order to maintain MADS with the current Rate of Penetration ("ROP") and SRE of the rig, such that the drilling fluid has the requisite properties for its intended use at the selected MADS ratio. The "base dilutant" may be either water, oil, or both, depending on the type of fluid being utilized to drill the well. MBR is calculated as follows: MBR=MDR−TPX. Using substitution:

$$MBR = \left(\frac{CV \times SRF \times WMF}{MADS}\right) - \left(\sum\left(\frac{Amountof\,Additive \times PCV}{EV}\right)\right).$$

Figure 7:
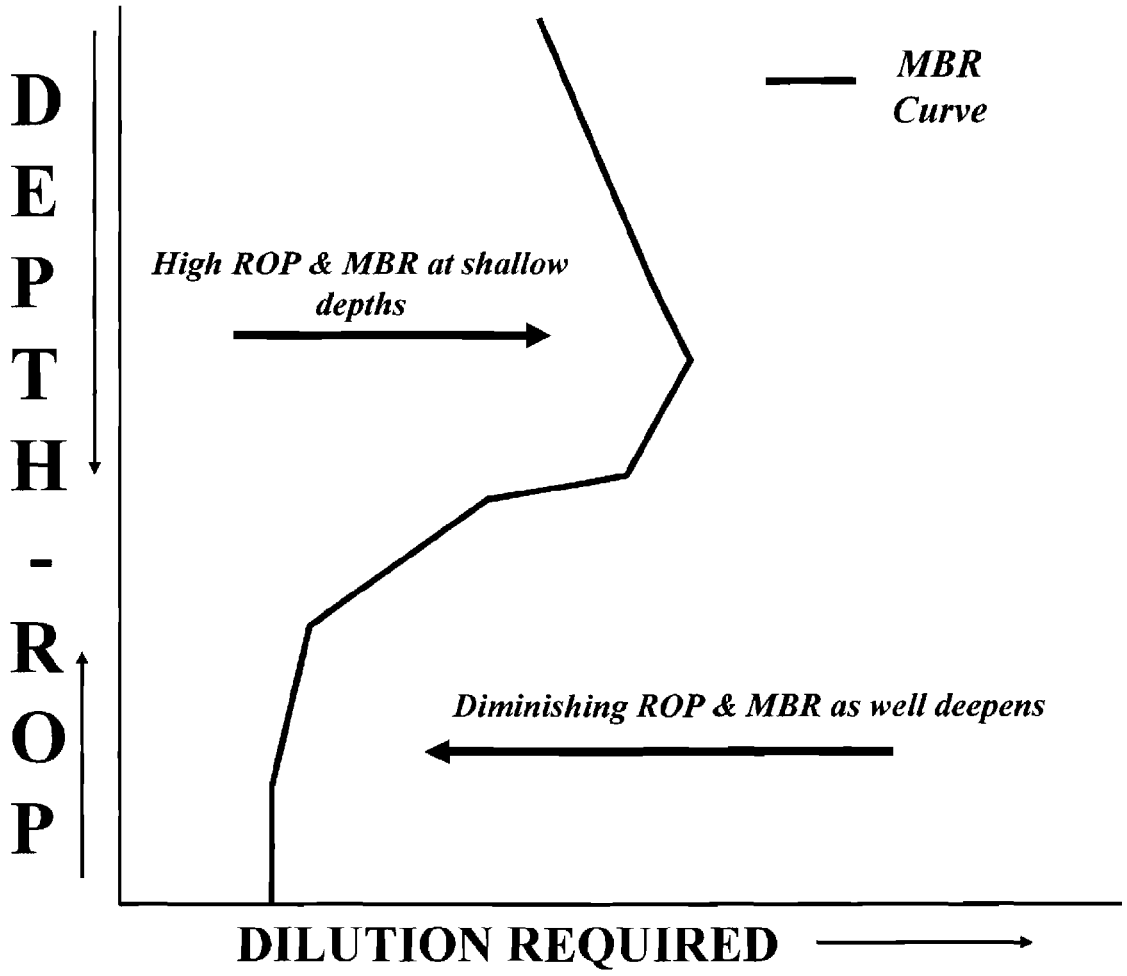
FIG. 7 is a chart showing a plot of an example of a MBR Curve, illustrating trends in ROP and MBR compared with wellbore depth.
Figure 8:
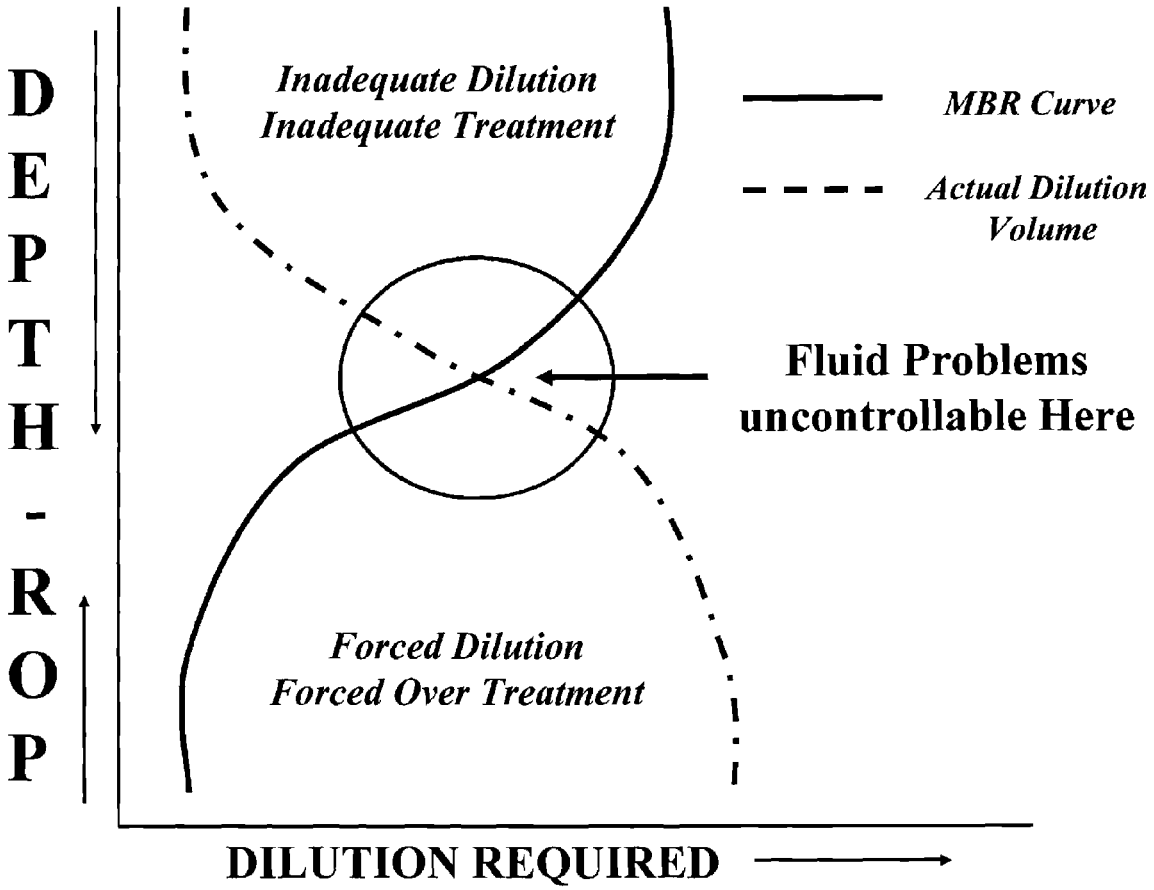
FIG. 8 is a chart showing a plot of a MBR Curve compared with the curve of Actual Dilution Volume, illustrating inadequate dilution and forced dilution trends.

Rate of Penetration ("ROP") refers to the speed at which a drill bit drills into a formation. ROP is often measured in terms of meters (or feet) per hour. In practice, deeper depths correspond with lower ROP values at a given point in time, t. An example of a MBR Curve, illustrating trends in ROP and MBR compared with wellbore depth is shown in FIG. 7. ROP results in an amount and volume of drilled solids. ROP also affects the SRE for the designated system and is used to calculate SRF. Therefore, the MBR can be expressed as a function of numerous variables including: ROP; drilling depth; t; DSF; SRE; SRF; selected MADS ratio; WMF; CV; MDR; PCV; and TPX.

As drilling conditions are continuously changing, the variables used in the MBR function also continuously change. At every point in time in drilling operations, a particular MBR exists and thus accurately satisfies these conditions.

Overview

Implementation of the current invention continuously and consistently alters the properties of the drilling fluid selected according to the MBR of the system and according to programmed fluid parameters. Continuous monitoring of the fluid properties, calculation of MBR, and administration of the correct volume of base dilutant and chemical products is necessary for optimization and consistency of the system. This process is recursively selected to perform at intervals and predefined event conditions over the course of drilling operations, such that the actual base dilutant and chemical products administered continuously change to fit with the corresponding "MBR Curve."

DETAILED DESCRIPTION OF THE ELEMENTS

An "MBR curve", as it is referred to in this invention, is the relationship between the ROP (or depth) of wellbore, the SRE of the individual rig, the bit diameter, MADS, and the corresponding MBR required at that specific ROP (or depth). Examples of MBR Curves are illustrated in FIGS. 3, 4, 5, 6, 7, and 8. Under-dilution causes drilling fluid problems, exposes the operator to unnecessary risk, causes "non-productive time ("NPT"), causes damage to the wellbore and/or equipment, and causes the fluid to be difficult to control. Over-dilution causes wasted time, unnecessary product expense, and increases in environmental disposal issues.

As the MBR curve is a continuous function, the MBR must also continuously change to fit this curve. In practice, a number of iterative steps must be implemented to match the curve as closely as possible. The accuracy and deviation of the MBR will depend on the accuracy and frequency of measurement, calculation, and properly timed Dilution Rate ("D-Rate") iterations. MBR must be delivered deliberately at planned periodic intervals to achieve proper fluid functionality. Application and calculation of MBR also occurs at every tour.

If drilling is not occurring, then application and calculation of MBR is not necessary. Certain events may cause a change in the corresponding MBR. Therefore, certain predefined event conditions require a system correction of MBR. The system correction requires application of the process and calculation of MBR. Since MBR is driven by ROP rates, a change in ROP will require recalculation of MBR, and thus constitutes a predefined event condition. In addition, penetration into a different formation may require selection of a new MADS ratio when high temperatures result in excessive evaporation. Therefore, a change in MADS ratio will also constitute a predefined event condition. Predefined event conditions contemplated by the current invention include changes in any of the dependent variables such as: ROP; drilling depth; DSF; SRE; SRF; selected MADS ratio; WMF; CV; MDR; PCV; and TPX.

As the drilling fluid circulates through the wellbore, it next rises to the surface and passes through SCE. Testing and implementation of the process can be performed at planned periodic intervals and at predefined event conditions. Efficiency of the solids control equipment must be measured at every tour.

Drilled solids are removed from the drilling fluid according to the efficiency of the machines utilized on each individual rig. Any number or combination of solids control equipment is contemplated by the current invention. As previously mentioned, not all drilled solids are removed, and the efficiency of the machine depends on the percentage of drilled solids removed. SRE/SRF is determined by fluids analysis and daily calculation.

MDR is based on several factors including: calculated Rig-specific SRE; bit diameter for a given interval; ROP for a given interval; and MADS retained in the drilling fluid. MDR specifies the volume of dilutant that must be added such that the percentage of drilling fluids is equal to the selected MADS ratio, without calculating for chemical product expansions. For purposes of calculating SRE/SRF, a drilling fluids engineer must select the appropriate MADS ratio and have accurate calculations for Total Dilution Volume required for the ROP/CV. WMF may be determined using the previous input values from SRF.

When chemical products are to be added to the drilling fluids, then PCV must be calculated. PCV indicates the concentration of the selected chemical products as they apply to the MDR (which includes drilled cuttings that are introduced into the wellbore). One or more chemical products may be added per tour while drilling. However, in some instances, no chemical additives may be added per tour while drilling. PCV is determined by the following: DS; SRF; WMF; and MADS.

TPX is calculated according to the determined PCV value(s). TPX takes into account the total expansion of the chemical products added after the selected chemical products have been introduced into the system. TPX is calculated as the sum of all the individual chemical product expansions.

MBR is calculated as the difference of MDR and TPX and can be expressed as follows: MBR=MDR−TPX. MBR indicates the amount of base dilutant that needs to be added to the drilling fluids. Since the majority of the relationships previously mentioned depend on a given MADS, ROP, and tour length, calculation of the rate of administration of dilutant is also possible. For example, the CV is dependent upon the ROP and the tour length. If the MBR of a system was calculated at 120 barrels for a tour of 12 hours, then the MBR could be administered at a D-rate of 10 barrels per hour (bbl/hr).

Scheduled delivery of base dilutant and chemical product are calculated and precisely administered at all times during the drilling of the well. Base dilutant is accurately measured by timed additions in the surface pits. Chemical product usage is planned and then is administered as instructed via rig delivery system. Software that produces the treatment sheet with these specifics for the administering rig personnel is included with the process. A flow sheet showing the process is illustrated in FIG. 1.

How the Invention is Used

The current invention is used to improve drilling efficiency and reduce costs by providing drilling fluids with consistent properties as opposed to reactive additions of uncalculated quantities that satisfy drilling fluid properties temporarily. Correct use and implementation of MBR insures the correct volume of base dilutant and chemical products will be added to drilling fluids to transform the drilling fluids to a state consistent with the selected MADS ratio and properties prescribed via the drilling fluids program. Various embodiments of the invention may implement different testing means, solids control equipment, means of calculation, and dilutant administration. However, the correlation and relationship between ROP rates, SRE, tour length, TPX, MADS, and CV determines the correct MBR for the system.

The invention may be used for any WMB, OBM, and SBM. In addition, calculation and measurement may be performed on any number of dilutant materials and chemical additives. Different MADS ratios may be selected by the fluids engineer based on drilling conditions. In addition, the number and frequency of measurement and iterations can be selected as necessary. The process will be performed at each iteration. The process will also be performed at predefined event conditions, such as a change in ROP or MADS.

In practice, calculations for MBR may be done using software. In this manner, the proper volume of base dilutant and additives are accurately administered at the same time. Target MBR Curves can be generated daily (or as scheduled) and can be tracked in real time for planning purposes. In addition, a detailed treatment sheet (which can be calculated using software) can be provided to administering rig-personnel to remove human error.

SPECIFIC EMBODIMENTS AND EXAMPLES

The following will show by example, an embodiment setting forth the best mode of carrying out the invention. In this embodiment and example, the ROP is 70 ft/hour. In the embodiment, drilling fluids engineers operate in successive "tours," or shifts of 12 hours. The process is implemented at the beginning of every tour. The process will also be implemented if a change in ROP occurs, or if a new MADS ratio must be selected (predefined event conditions). SRE is determined to be 75%. A MADS ratio of 6% is selected.

In this embodiment, the fluid used is WBM. A drill bit with diameter of 9⅝" is used. The solids control equipment is comprised of a shale shaker. Treated drilling fluids pass through the shale shaker and into a setting pit at a given rate, measured in barrels per minute ("BPM"). Drilling fluids pass from the setting pit to the intermediate or mixing pit for introduction of dilutants and chemical products. From the intermediate pit, the fluids move to the suction pit and are introduced into the drill string by the mud pump. The drilling fluids engineer is able to determine the total Cuttings Volume, or CV for the selected interval, is 75.60 bbls.

The drilling fluids engineer must next calculate MDR. As previously mentioned, a MADS ratio of 6% is selected. Therefore, the WMF of the system is determined to be 94%. Since SRE of the embodiment is 75%, then SRF would be 25%. Therefore, the calculated MDR for the system would be 296.08 bbls according to the relationships previously described. In the field, this measurement can be quickly calculated by a software program implemented by a computer.

It is determined that a number of chemical products are necessary to be added to the drilling fluid. In this example, the following products are programmed to be added: Barite, 80.0 lbs/bbl; Bentonite, 12.50 lbs/bbl; Drispac, 0.25 lbs/bbl; Lignite 1.0 lbs/bbl; Caustic Soda, 0.75 lbs/bbl; and Calcium Carbonate, 2.0 lbs/bbl.

The drilling fluids engineer must calculate Product Concentration Volume (PCV). CV, SRF, WMF, and MADS have been previously determined. Therefore, PCV is calculated to be 333.88 barrels according to the relationships previously described. By utilizing PCV as the concentration factor, system concentrations of chemical product are not diminished by cuttings entry into the wellbore and subsequent removal at the surface.

The drilling fluids engineer must next calculate TPX. The individual EV for each additive are then calculated as follows: Barite, 1469.4 lbs/bbl; Bentonite, 909.6 lbs/bbl; Drispac, 559.8 lbs/bbl; Lignite 531.8 lbs/bbl; Caustic Soda, 533.5 lbs/bbl; and Calcium Carbonate, 962.1 lbs/bbl. Individual PX can be calculated using the Amount Total Pounds of Additive, individual EV, and PCV. Respective PX values are then calculated as follows: Barite, 18.18 bbls; Bentonite, 4.59 bbls; Drispac, 0.15 bbls; Lignite 0.63 bbls; Caustic Soda, 0.47 bbls; and Calcium Carbonate, 0.694 bbls. TPX is calculated as the sum of the individual PX values. Therefore, TPX is calculated as 24.71 bbls according to the relationships previously described.

MBR can now be calculated by the drilling fluids engineer. As previously mentioned, MBR is the difference of MDR and TPX. Therefore, in this example, MBR can be calculated as 271.4 lbs. Since the calculated MBR was based on a 12-hour tour, the drilling fluids engineer can also determined the appropriate rate of administration of base dilutant. To properly match the MBR curve, base dilutant must be administered at a D-rate of 22.6 barrels per hour (bbls/hr).

Figure 2:
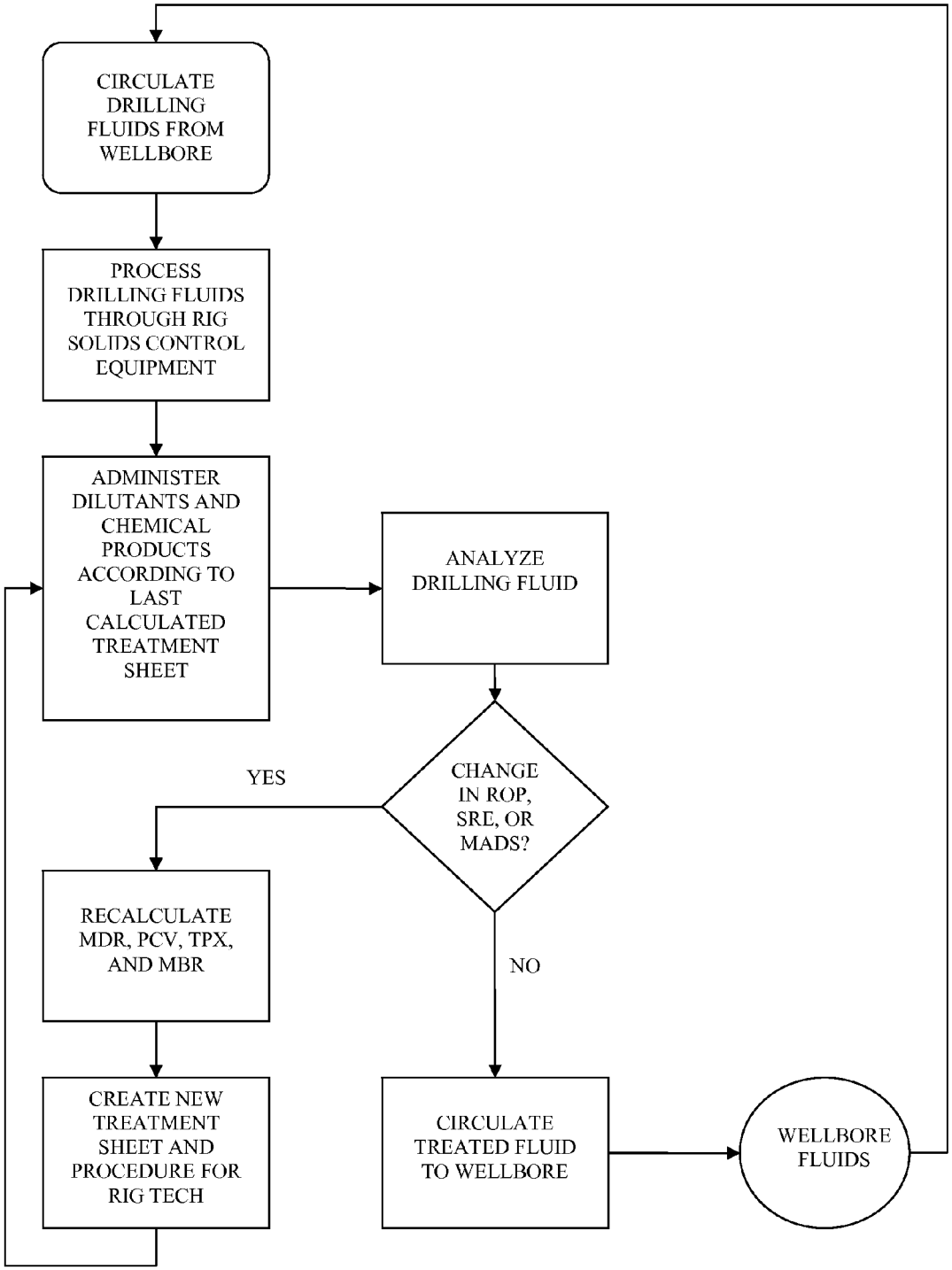
FIG. 2 is a program flow chart of an embodiment of the current invention, in which predefined event conditions include a change in Rate of Penetration ("ROP") and a change in Maximum Allowable Drilled Solids ("MADS")
Figure 3:
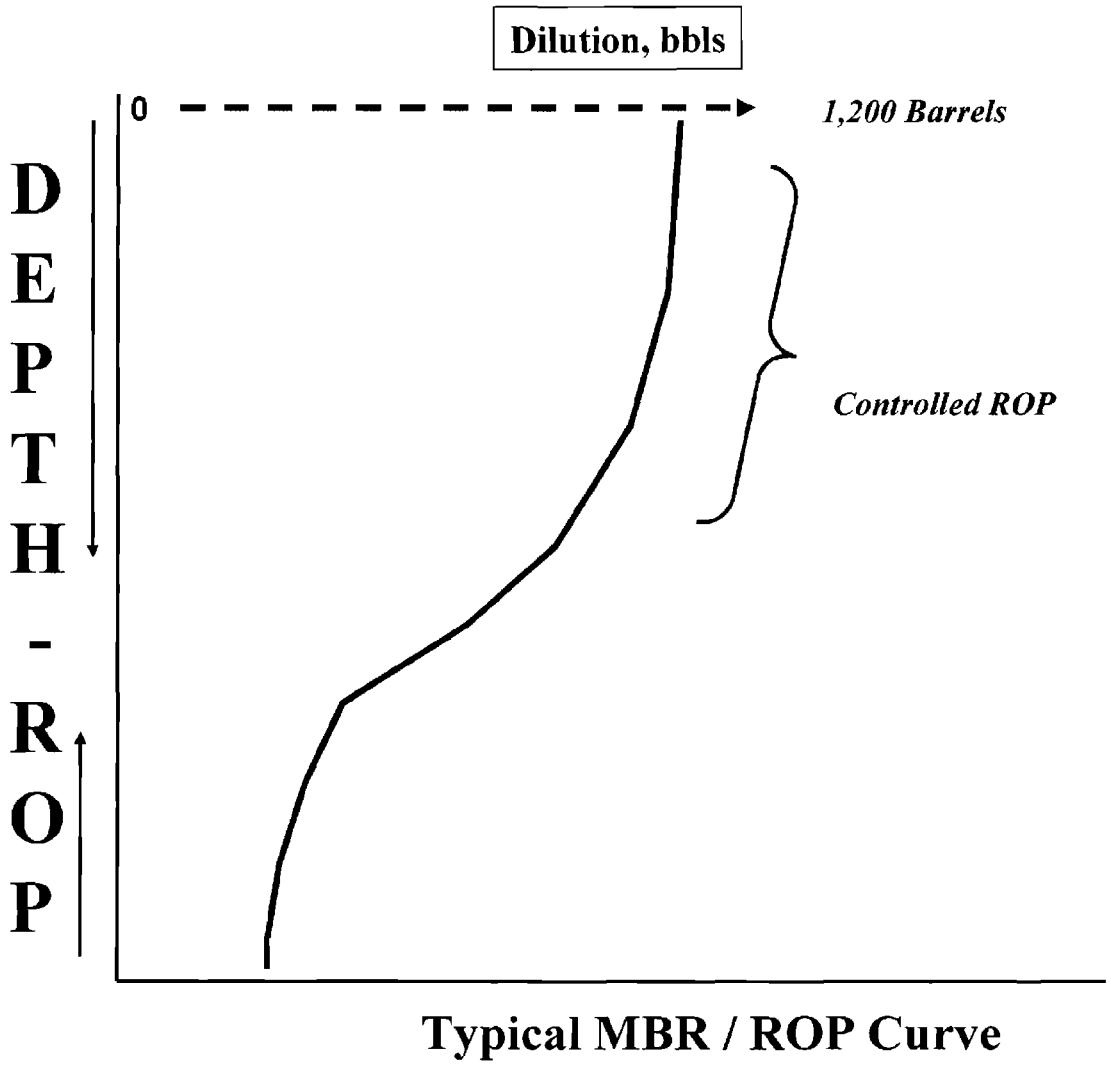
FIG. 3 is a chart showing a plot of an example of a Minimum Base Dilutant Required Curve ("MBR Curve") compared with the curve of Actual Dilution Volume.
Figure 4:
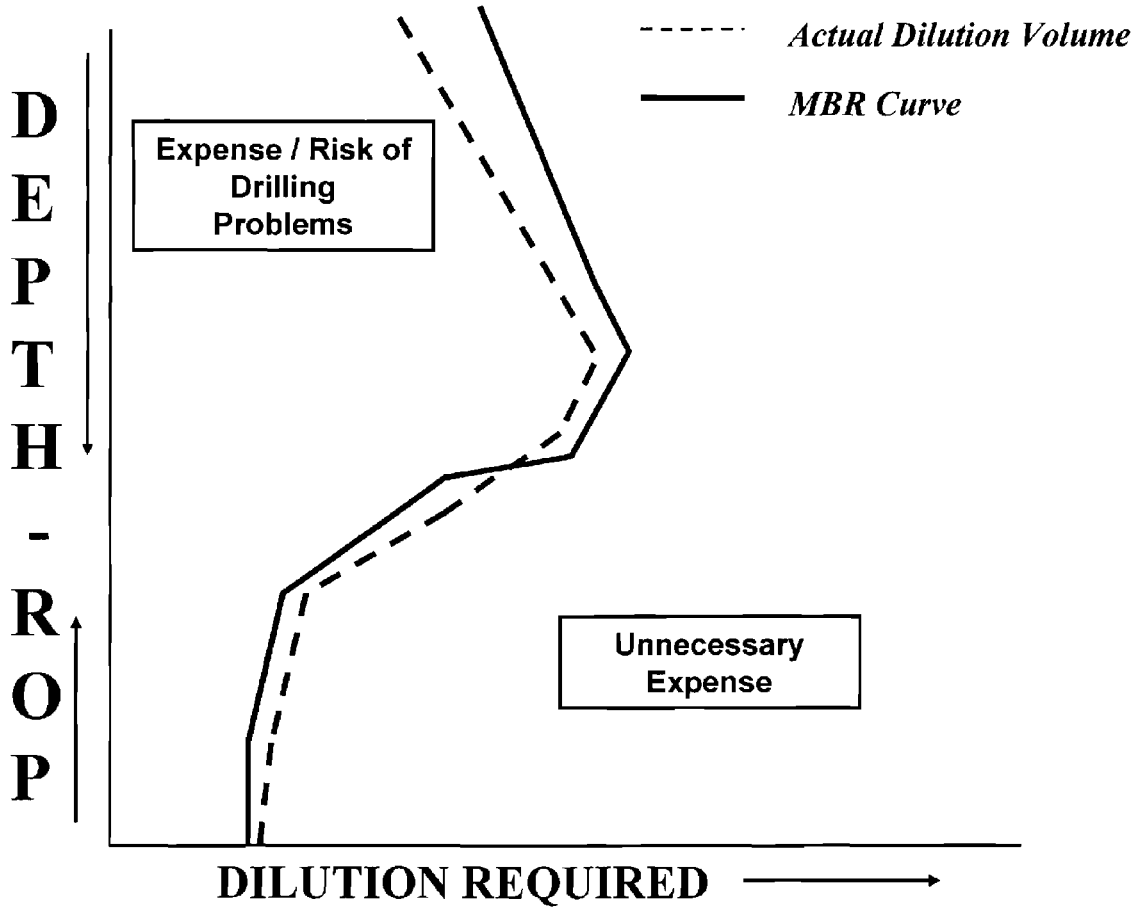
FIG. 4 is a chart showing an example of a MBR Curve.
Figure 5:
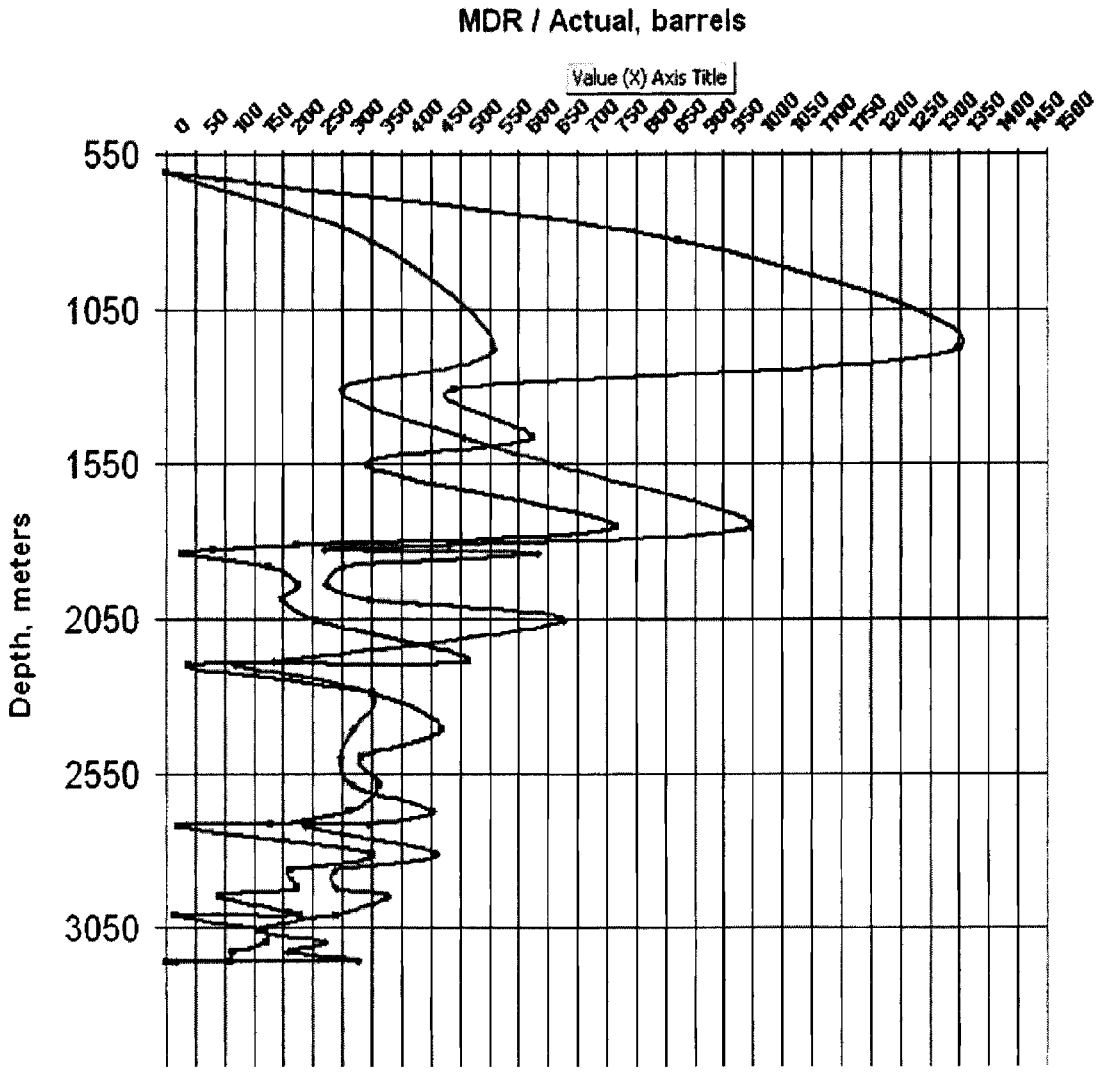
FIG. 5 is a chart showing a plot of a MBR Curve compared with the curve of Actual Dilution Volume using sample data from a wellbore.
Figure 6:
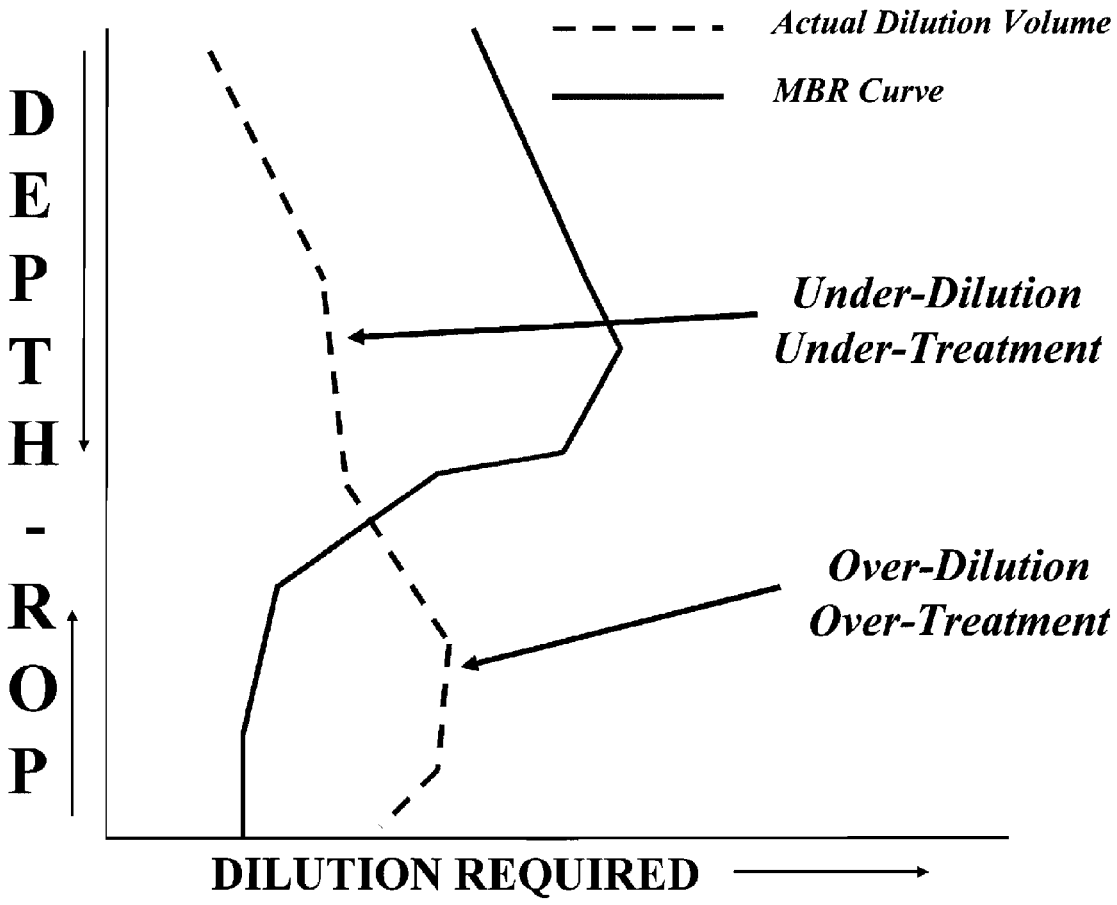
FIG. 6 is a chart showing a plot of an example of a MBR Curve compared with the curve of Actual Dilution Volume, illustrating under-treatment and over-treatment.

Practical administration of a precise volume must be available at any rig for proper MBR administration. Adding base dilutant may be accomplished by several ways. If water/oil meters are not available, then administration in this example may be accomplished by introduction of the base dilutant into a 5 gallon bucket. The 5 gallon bucket is filled with the source of base at a rate of 22.6 bbls per hour (19 seconds to fill the 5 gallon container). The base dilutant and properly measured and tourly-timed additives are administered into the mixing pit at the calculated rates delivered by the treatment sheet while drilling and circulating. The treatment continues at all times while drilling operations are occurring. System correction is performed recursively at either the expiration of a tour or at a change in MADS or ROP. A flowchart illustrating the embodiment is illustrated in FIG. 2.

Alternatives

As proper and timely inputs are required for calculation, the current invention may implement different means for input. Input variables may be measured by a number of types of equipment including (but not limited to): a mud balance; a viscosity cup and Marsh Funnel; a variable speed Rheometer; an API Low Pressure Filter Press; an HTHP Filter Press; an Electrical Stability Meter; a pH meter; a retort; a Methylene Blue Test (MBT) Kit; and Titration equipment for alkalinites. In addition, software may be utilized to interpret and calculate values provided by the physical and chemical analysis of the fluid. It is contemplated by the current invention that input values may also be communicated by way of computer transmission.

The current invention may implement different means for calculation and project planning. Calculation of the various relationships may be done manually by the drilling fluids engineer or by an operations manager in an office. Calculation by a computer is also contemplated by the current invention. A computer simulation may present a projected MBR Curve, showing the relationships between the MBR versus ROP; or between MBR and MADS, SRE, or wellbore diameter. Projected MBR rates at different intervals and time periods may also be simulated by computer to inform the drilling fluids engineer and operations manager of the correct rate of administration of base dilutant and product.

The current invention may implement different means for administration of base dilutants and chemical products. As previously mentioned, a container or bucket of known volume may be used to administer base dilutants accurately into a mixing pit. It is also contemplated by the current invention that the use of hoses, pumping equipment, meters, or other mechanical means may administer base dilutant/product according to the relationships of the current invention.

The current invention may implement different means for solids control. As previously mentioned, solids control equipment may include one or more of the following: fluids processing system; shale shaker; desander; desilter; centrifuge; degasser; mud gas separator; centrifugal pump; and/or mud tank. Measurements of the efficiency of each these machines may be determined using testing and calculation. It is also contemplated by the current invention that the solids control equipment may have its own means of determining SRE, SRF, or CV. Therefore, the spirit and scope of the appended claims should not be limited to the descriptions of the preferred versions herein.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A method that continuously changes a physical state and characteristics of a drilling fluid, comprising:

a. initiating a system correction of a Minimum Base Required ("MBR");

b. administering a dilutant to said drilling fluid according to said MBR; and c. wherein said MBR is a difference of Minimum Dilution Required ("MDR") and Total Product Expansions ("TPX).

2. The method of claim 1, wherein said system correction is initiated at planned periodic intervals.

3. The method of claim 1, wherein said system correction is initiated at predefined event conditions.

4. The method of claim 1, wherein said system correction is initiated at planned periodic intervals and predefined event conditions.

5. The method of claim 1, wherein said system correction is initiated at planned periodic intervals or predefined event conditions.

6. The method of claim 5, wherein said planned periodic intervals are "tours" of 12 hours in duration.

7. The method of claim 5, wherein said predefined event conditions are a change in Rate of Penetration ("ROP"), and a change in Maximum Allowable Drilled Solids ("MADS").

8. The method of claim 7, wherein said predefined event conditions further include a change in Solids Removal Efficiency ("SRE").

9. The method of claim 5, wherein said predefined event conditions are a change in Rate of Penetration ("ROP"), or a change in Maximum Allowable Drilled Solids ("MADS").

10. The method of claim 9, wherein said predefined event conditions further include a change in Solids Removal Efficiency ("SRE").

11. The method of claim 1, wherein said method is performed recursively while drilling operations are occurring.

12. The method of claim 1, further including the step of re-circulating said drilling fluid through a drill string in a wellbore.

13. The method of claim 1, further including the step of continuously monitoring Rate of Penetration ("ROP"), and a change in Maximum Allowable Drilled Solids ("MADS").

14. The method of claim 13, further including the step of continuously monitoring changes in Solids Removal Efficiency ("SRE").

15. The method of claim 1, further comprising determining input variables for said system correction.

16. The method of claim 15, wherein determining said input variables can be measured by a mud balance; a viscosity cup and Marsh Funnel; a variable speed Rheometer; an API Low Pressure Filter Press; an HTHP Filter Press; an Electrical Stability Meter, a pH meter; a retort; a Methylene Blue Test (MBT) Kit; or Titration equipment for alkalinites.

17. The method of claim 15, wherein said input variables are transmitted for said system correction via computer transmission.

18. The method of claim 1, further including the step of passing said drilling fluid through Solids Control Equipment ("SCE").

19. The method of claim 18, wherein said SCE is a fluids processing system, a shale shaker, a mud cleaner, a desander, a desilter, a centrifuge, a degasser, a mud gas separator, or a settling tank.

20. The method of claim 1, wherein said drilling fluid is water based mud ("WBM"), oil-based mud ("OBM"), or synthetic based fluid ("SBM").

21. The method of claim 1, wherein said TPX is a sum of individual Product Expansions ("PX").

22. The method of claim 1, wherein said MDR is a function of Cuttings Volume ("CV"), Solids Retention Fraction ("SRF"), Whole Mud Fraction ("WMF"), and Maximum Allowable Drilled Solids ("MADS").

23. The method of claim 1, wherein said dilutant is administered by a container; a hose; a system of hoses; a meter; or pumping equipment.

24. The method of claim 1, wherein computer software generates a treatment sheet for administering said MBR.

25. The method of claim 1, further including the step of administering chemical products according to said MBR.

26. A method that continuously changes a physical state and characteristics of a drilling fluid, comprising administering a dilutant to said drilling fluid according to a Minimum Base Required ("MBR"); wherein said MBR is the difference of Minimum Dilution Required ("MDR") and Total Product Expansions ("TPX"); and wherein said TPX is a sum of individual Product Expansions ("PX").

27. The method of claim 26, further comprising administering chemical products according to said MBR.

28. An apparatus that continuously changes a physical state and characteristics of a drilling fluid, comprising:

a. a means for initiating a system correction of a Minimum Base Required ("MBR");

b. a means for calculating said MBR;

c. a means for administering a dilutant to said drilling fluid according to said MBR; and d. wherein said MBR is the difference of Minimum Dilution Required ("MDR") and Total Product Expansions ("TPX").

29. The apparatus of claim 28, further comprising a means for continuously monitoring a change in Rate of Penetration ("ROP").

30. The apparatus of claim 29, wherein said means for continuously monitoring a change in said ROP comprises Measurement While Drilling ("MWD") tools.

31. The apparatus of claim 28, wherein said means for initiating said system correction of MBR is a computer, implementing software programmed to initiate said fluid system correction at planned periodic intervals and predefined event conditions.

32. The method of claim 31, wherein said planned periodic intervals are "tours" of 12 hours in duration.

33. The method of claim 31, wherein said predefined event conditions are a change in Rate of Penetration ("ROP"), and a change in Maximum Allowable Drilled Solids ("MADS").

34. The method of claim 33, wherein said predefined event conditions further include a change in Solids Removal Efficiency ("SRE").

35. The method of claim 28, wherein said means for calculating said MBR comprises a computer, programmed to calculate said MBR.

36. The method of claim 28, wherein input variables are transmitted to a computer for calculation.

37. The method of claim 36, wherein said input variables are determined by a mud balance; a viscosity cup and Marsh Funnel; a variable speed Rheometer; an API Low Pressure Filter Press; an HTHP Filter Press; a pH meter; a retort; an Electrical Stability Meter; a Methylene Blue Test (MBT) Kit; or Titration equipment for alkalinites.

38. The method of claim 28, wherein said means for administering said dilutant comprises a hose, or system of hoses, which administer said MBR according to computer instruction.

39. The method of claim 28, further including a means for administering chemical products according to said MBR.

40. The method of claim 39, wherein said means for administering said chemical products comprises the use of standard rig equipment.

* * * * *